US007735851B2

(12) United States Patent
Shute et al.

(10) Patent No.: US 7,735,851 B2
(45) Date of Patent: Jun. 15, 2010

(54) PIVOTING TELEMARK SKI BINDING, SKI CRAMPON, AND HEEL LIFTER

(75) Inventors: Cameron Shute, Vancouver (CA); Ernest McCrank, North Vancouver (CA); James Shaw, Squamish (CA); James Rogers, North Vancouver (CA); Oliver Steffen, North Vancouver (CA)

(73) Assignee: G3 Genuine Guide Gear Inc., North Vancouver, BC (CA)

( * ) Notice: Subject to any disclaimer, the term of this patent is extended or adjusted under 35 U.S.C. 154(b) by 884 days.

(21) Appl. No.: 11/509,696

(22) Filed: Aug. 25, 2006

(65) Prior Publication Data

US 2007/0045987 A1 Mar. 1, 2007

Related U.S. Application Data

(60) Provisional application No. 60/710,877, filed on Aug. 25, 2005.

(51) Int. Cl.
*A63C 9/02* (2006.01)

(52) U.S. Cl. ..... 280/614; 280/613; 280/618

(58) Field of Classification Search ..... 280/611, 280/613, 614, 615, 619, 620, 621, 618
See application file for complete search history.

(56) References Cited

U.S. PATENT DOCUMENTS 4,322,090 A * 3/1982 Loughney ..... 280/614
4,410,199 A 10/1983 Eisenberg
4,557,498 A 12/1985 Bernhardson
4,659,103 A * 4/1987 Tessaro ..... 280/615
4,917,400 A 4/1990 Salomon
5,823,563 A 10/1998 Dubuque
6,409,204 B1 6/2002 Ayliffe
6,877,759 B2 * 4/2005 Dandurand ..... 280/614
7,216,888 B1 5/2007 Walker
7,216,890 B2 5/2007 Walker
7,306,255 B2 12/2007 Walker
7,306,256 B2 12/2007 Walker
7,318,597 B2 1/2008 Walker
7,396,037 B2 7/2008 Walker (Continued)

FOREIGN PATENT DOCUMENTS

DE 20007032 U1 9/2000

(Continued)

OTHER PUBLICATIONS

Dawson, L. "Details of early Silvretta . . . cable binding . . . circa 1968" in Lou Dawson's Backcountry Skiing Blog [online; retrieved on Jul. 15, 2009]. Retrieved from the Internet: <url: wildsnow.com> (2 pages).

(Continued)

*Primary Examiner*—Hau V Phan
*Assistant Examiner*—John D Walters

(57) ABSTRACT

A pivoting telemark binding is provided which includes a toe piece pivotally connected to a base plate and a mechanism for locking the toe piece relative to the base plate to prevent pivoting. An actuator for the locking mechanism is placed at the front end of the binding to be positioned over the ski. Also provided is a ski crampon for use with this binding, as well as a heel lifter device for use with any telemark binding.

9 Claims, 22 Drawing Sheets

U.S. PATENT DOCUMENTS

| | | | | |
|---|---|---|---|---|
| 7,401,802 | B2 | 7/2008 | Walker | |
| 2003/0098570 | A1* | 5/2003 | Ayliffe | 280/624 |
| 2006/0087102 | A1 | 4/2006 | Coles | |
| 2007/0108735 | A1 | 5/2007 | Walker | |
| 2007/0108737 | A1 | 5/2007 | Walker | |
| 2007/0108738 | A1 | 5/2007 | Walker | |
| 2008/0116663 | A1* | 5/2008 | Gyr | 280/611 |

FOREIGN PATENT DOCUMENTS

| | | | |
|---|---|---|---|
| DE | 20021684 | U1 | 5/2001 |
| DE | 10159732 | A1 | 7/2002 |
| FR | 2536289 | A1 | 5/1984 |

OTHER PUBLICATIONS

Eckart; English translation of claims of German design patent DE 2007032 U1 published Sep. 7, 2000 (2 pages).

Zoor; English translation of German design patent DE 20021884 U1 published May 10, 2001 (14 pages).

Zoor; English translation of German patent application DE 10159732 Al published Jul. 4, 2002 (7 pages).

Salewa Sportgerate GmbH; "User instructions/Customer/Silvretta Telemark Touring Adaptor" May 2004; Aschheim, Germany (cover page and p. 2).

Advertisements for Karhu 7 Tm Tour binding and Silvretta Telemark Adaptor; "Backcountry Magazine", Oct. 2004 (cover page and p. 64).

Dr. Telemark. "Karhu to introduce 7 Tm Tour Model . . . Fall 2004" in Dr. Telemark Reviews Tech Stuff and Morel [online; retrieved on Jul. 15, 2009]. Retrieved from the internet; <url: www.telemarktips.com> (2 pages).

G3 Genuine Guide Gear Inc. "Pressroom/G3 News Releases . . . G3 Targa Ascent Delivers Power to Backcountry Telemarkers" [online] North Vancouver, BC, Canada, Dec. 12, 2005; [retrieved on Jul. 23, 2009]. Retrieved from the internet: <url: www.genuineguidegear.com> (2 pages).

Dr. Telemark. "Black Diamond 01 Touring Mode Telebinding for Fall '06" in Telemarktips.com First Look [online]. Dec. 17, 2005 [retrieved on Jul. 15. 2009]. Retrieved from the internet: <url: www.telemarktips.com> (3 pages).

* cited by examiner

FIG. 7A
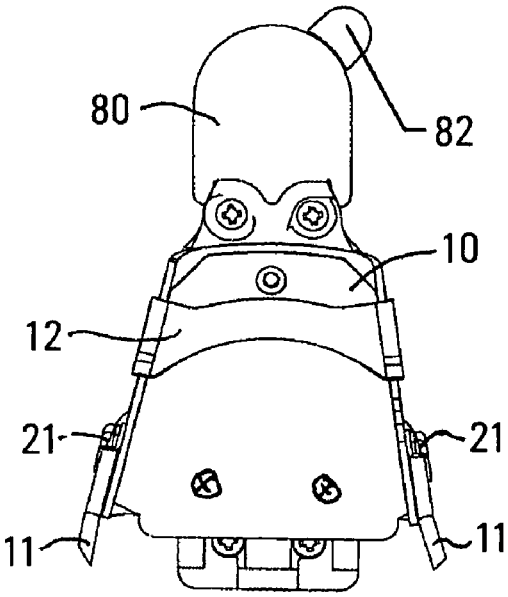
FIG. 7B
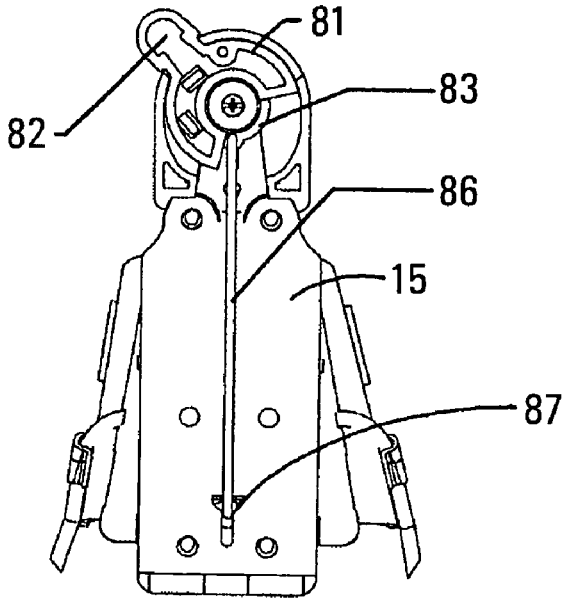
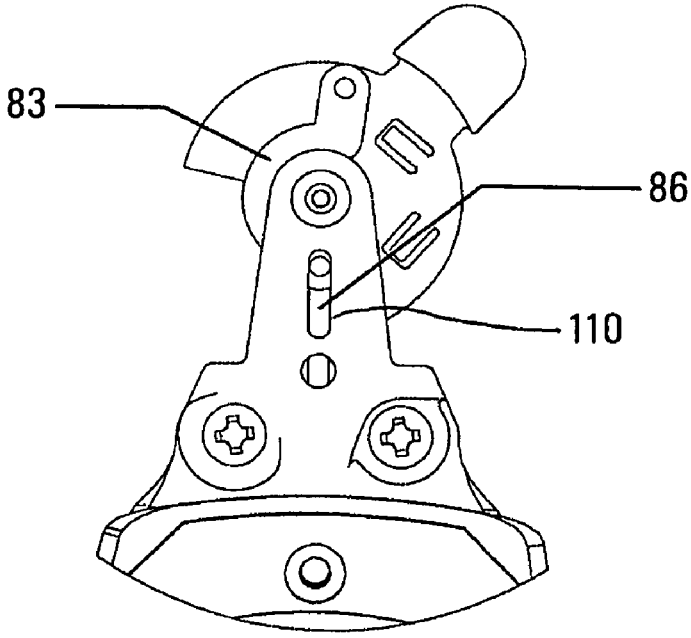
FIG. 7C

PIVOTING TELEMARK SKI BINDING, SKI CRAMPON, AND HEEL LIFTER

CROSS REFERENCE TO RELATED APPLICATIONS

This application claims priority to U.S. provisional patent application Ser. No. 60/710,877 filed Aug. 25, 2005, the content of which is hereby incorporated by reference.

FIELD OF THE INVENTION

This invention relates to ski bindings adapted for use with a flexible ski boot and which allow a heel portion of the boot to lift free of the upper surface of the ski while in use.

BACKGROUND OF THE INVENTION

Telemark ski bindings are used with boots that are capable of flexing in the metatarsal region ("telemark boots"). This permits the heel of the boot to lift when walking or during the performance of a "telemark" turn when sliding downhill. Telemark bindings comprise a toe piece adapted to engage the toe of a telemark boot. The boot toe is retained within the toe piece by one or more of a variety of means. Traditionally, the toe piece is fixed to the top of the ski and does not move relative to the ski. In the traditional arrangement, flex of the boot is what enables the boot heel to be raised and lowered relative to the ski surface. While the use of rigid materials in boot manufacture has permitted a greater degree of control while performing downhill maneuvers, such boots restrict flex and require more energy to be expended by the user while walking and climbing.

Some telemark bindings have been designed to be pivotally mounted to a ski which allows for greater freedom and ease of movement while walking and climbing. However, it is preferable that the toe piece be fixed relative to the upper ski surface and not allowed to pivot during downhill maneuvers. Several mechanisms have been proposed which enable the user to alternate between a free-pivot arrangement for use during touring and a "locked" position for use when performing downhill maneuvers (see: DE 20007032 of Eckart; FIGS. 7 and 8 of DE 10159732 of Zoor; and the binding sold under the trade-mark "7™ Tour").

SUMMARY OF THE INVENTION

This invention provides a telemark binding comprising a toe piece pivotally connected to a base plate and which includes a locking mechanism. The binding has two modes of operation. The pivot axis is oriented perpendicular to the direction of the ski and parallel to the ski surface. In the ski mode, the locking mechanism is engaged and prevents the binding from pivoting relative to the ski. In touring mode, the locking mechanism is disengaged, allowing for pivoting of the binding relative to the ski, permitting greater degree of freedom and ease in movement while walking or climbing.

In a first aspect, this invention includes a telemark ski binding having a front end and a rear end when oriented in the direction of ski travel, the binding comprising: (a) a base plate for attachment of the binding to a ski; (b) a telemark binding toe piece pivotally attached to the base plate to permit the toe piece to pivot upward from the ski and toward the front end of the binding; (c) a lock near the rear end of the binding which when engaged provides a releasable connection between the toe piece and the base plate to prevent said pivoting; (d) an actuator to engage and disengage the lock, the actuator being at the front end of the binding to be positioned over the ski; and (e) a link between the actuator and the lock. The link will extend between the actuator and the lock along a route generally parallel to the base plate. The link may extend above, beneath, or at least in part, through the base plate structure. The link may be a solid link. The actuator may comprise a lever which operates a rotating element having an eccentric connection between the rotating element and the link. The latter feature provides for an over-center operation of the actuator. The binding may further comprise a pivot body with the pivot body being pivotally connected to the base plate and the toe piece being removably attached to the pivot body. The binding may further comprise a resilient dampener on the base plate. The dampener is compressed when the toe piece is pivoted toward the base plate to the position where the ski mode may be engaged.

A pivoting telemark ski binding of this invention may include a moveable receiver that cooperates with a latch on the undersurface of a binding toe piece and is adapted to translate forces through the toe piece to a base plate which is to be fixed to a ski surface. The latch may be removable from the toe piece. The latch may comprise at least two spaced-apart posts connected by a web or bar. The spaced-apart posts will support the toe piece on the base plate such as when the binding is in a position to engage the ski mode. The posts may be adapted to receive threaded fasteners for attachment to the toe piece. The binding may also comprise a pivot body, pivotally attached to the base plate forward of the latch and to which the toe piece is attached. The locking mechanism may operate by sliding engagement of the receiver to the latch. Sliding may be in forward/rearward directions. A resilient dampening member may be included which biases the latch into tight engagement with the receiver when the binding is locked in touring mode.

A pivoting telemark ski binding of this invention comprises a link connecting a receiver of the locking mechanism to an actuator situated at the front of the binding such that the actuator will be located ahead of the user's foot and is positioned over the surface of the ski. This minimizes accidental operation of the actuator, damage to the actuator, and permits use of the locking mechanism, even when a ski crampon is attached to the binding.

This invention also provides a heel lifter having an over-center capability when in an extended mode. In this aspect, the invention includes a heel lifter for use with telemark bindings, the lifter having open and closed positions, which comprises a base plate for attachment to a ski and a heel plate pivotally attached to the base plate near one end of the heel plate, the base plate and the heel plate being connected by one or more linear resilient members, the one or more resilient members being attached to the heel plate at an over-center position relative to the pivot such that the one or more resilient members are under tension when the lifter is in either the open or the closed positions. Heel lifters of this invention make use of one or more linear resilient members arranged to urge the lifter past a center point into either the elevated or the collapsed position. The resilient member may be elastomeric links.

This invention also provides a ski crampon for use with a pivoting telemark ski binding of this invention. In this aspect, the invention includes a ski crampon for use with a pivoting telemark binding, the binding having a front end and a rear end when oriented in the direction of ski travel, the binding comprising: (a) a base plate for attachment of the binding to a ski; (b) a telemark binding toe piece pivotally attached to the base plate to permit the toe piece to pivot upward from the ski and toward the front end of the binding; (c) a lock near the rear end of the binding which when engaged provides a releasable connection between the toe piece and the base plate to prevent said pivoting; (d) an actuator to engage and disengage the lock, the actuator being at the front end of the binding to be positioned over the ski; and (e) a link between the actuator and the lock through or beneath the base plate, wherein the ski crampon comprises vertically oriented toothed portions connected by a generally horizontal plate, the horizontal plate to be positioned between the base plate and the toe piece of the binding, the horizontal plate comprising a passage through which the lock of the binding will operate. The crampon is attachable beneath the toe piece of the ski binding and comprises a cut-away portion or passage through which the lock will function. Through use of this crampon, the locking mechanism of the pivoting binding may be engaged or disengaged while the crampon is installed.

This invention also provides ski bindings which include a combination of one or more aspects of this invention as described above.

BRIEF DESCRIPTION OF THE DRAWINGS

FIGS. 7A and 7B are top and bottom views, respectively, of a binding of this invention. FIG. 7C is a top view of an actuator mechanism.

DETAILED DESCRIPTION OF CERTAIN EMBODIMENTS OF THE INVENTION

Figure 1:
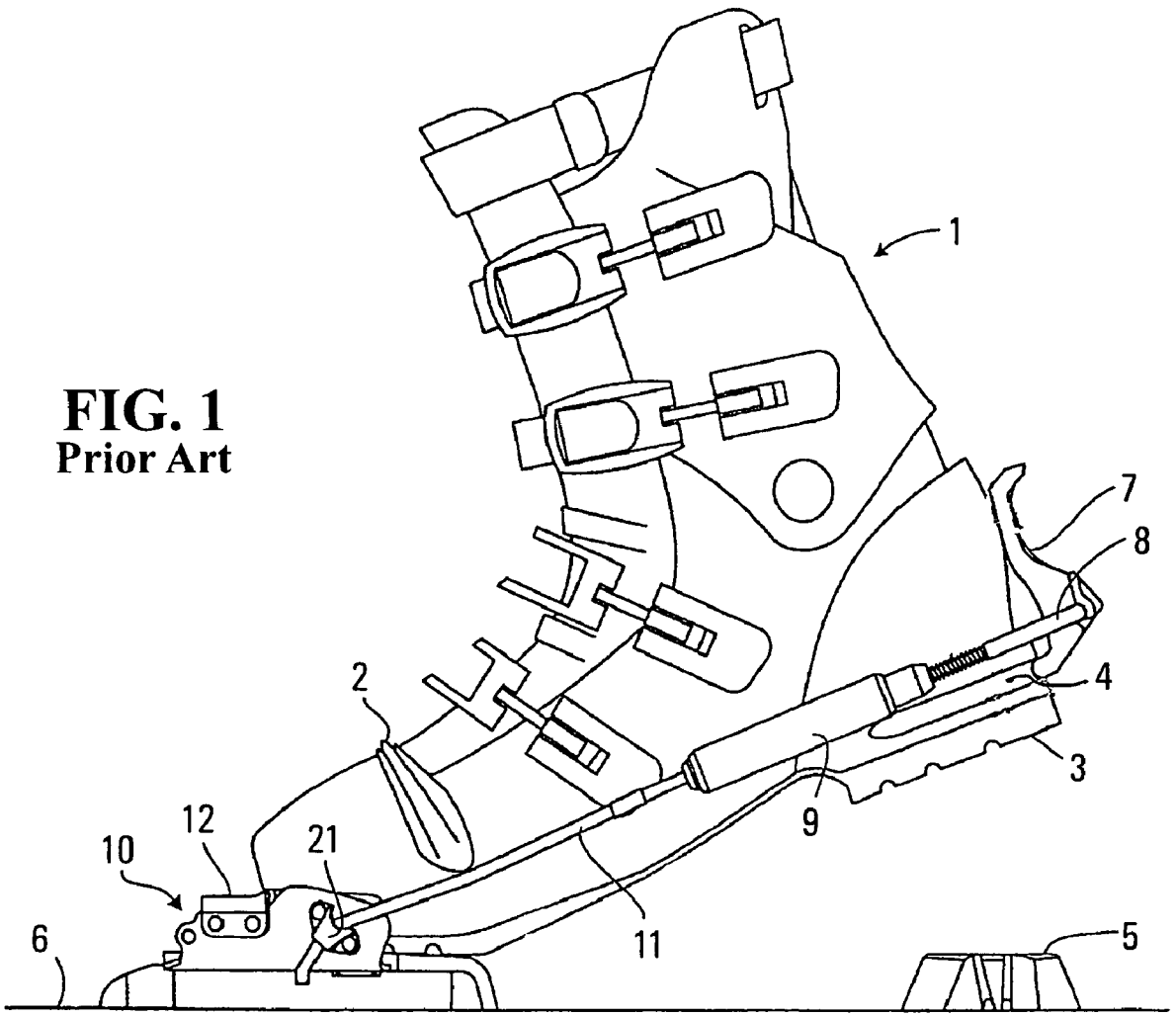
FIG. 1 Prior Art
FIG. 1 is a side view showing a GARMONT™ boot in a TARGA™ touring binding (prior art). The binding is shown relative to the upper surface of a ski to which the binding components are fixed. The boot is shown in an elevated position typical of what occurs during walking, climbing, and telemark turn maneuvers.

FIG. 1 illustrates a modern plastic telemark boot 1 placed in a prior art touring binding consisting of toe piece 10 which retains the toe of the boot. Boot 1 is shown in an elevated position made possible by the flexibility of compressible bellows 2 of boot 1. The touring binding may also comprise heel plate 5 which is typically a separate component fixed to the upper ski surface (represented by line 6), on which the heel 3 of the boot will rest when the upper boot is not in an elevated position. The boot 1 is partially retained by means of bar or plate 12 which extends across the toe portion of the boot sole (not shown). Boot 1 is o retained in toe piece 10 by tension forces delivered to the boot through a cable and bail assembly which in the TARGA™ model comprises flexible cable 11, bail 8, and heel tensioning lever 7, which engages groove 4 at the rear of the boot. Bail 8 has a threaded end adapted for coaxial engagement with compression spring cartridge 9 which is in coaxial engagement with flexible cable 11. The cable/bail assembly is held by cable guide 21 on the toe piece 10. Toe piece 10 is fixed to the upper ski surface represented by line 6.

Figure 2:
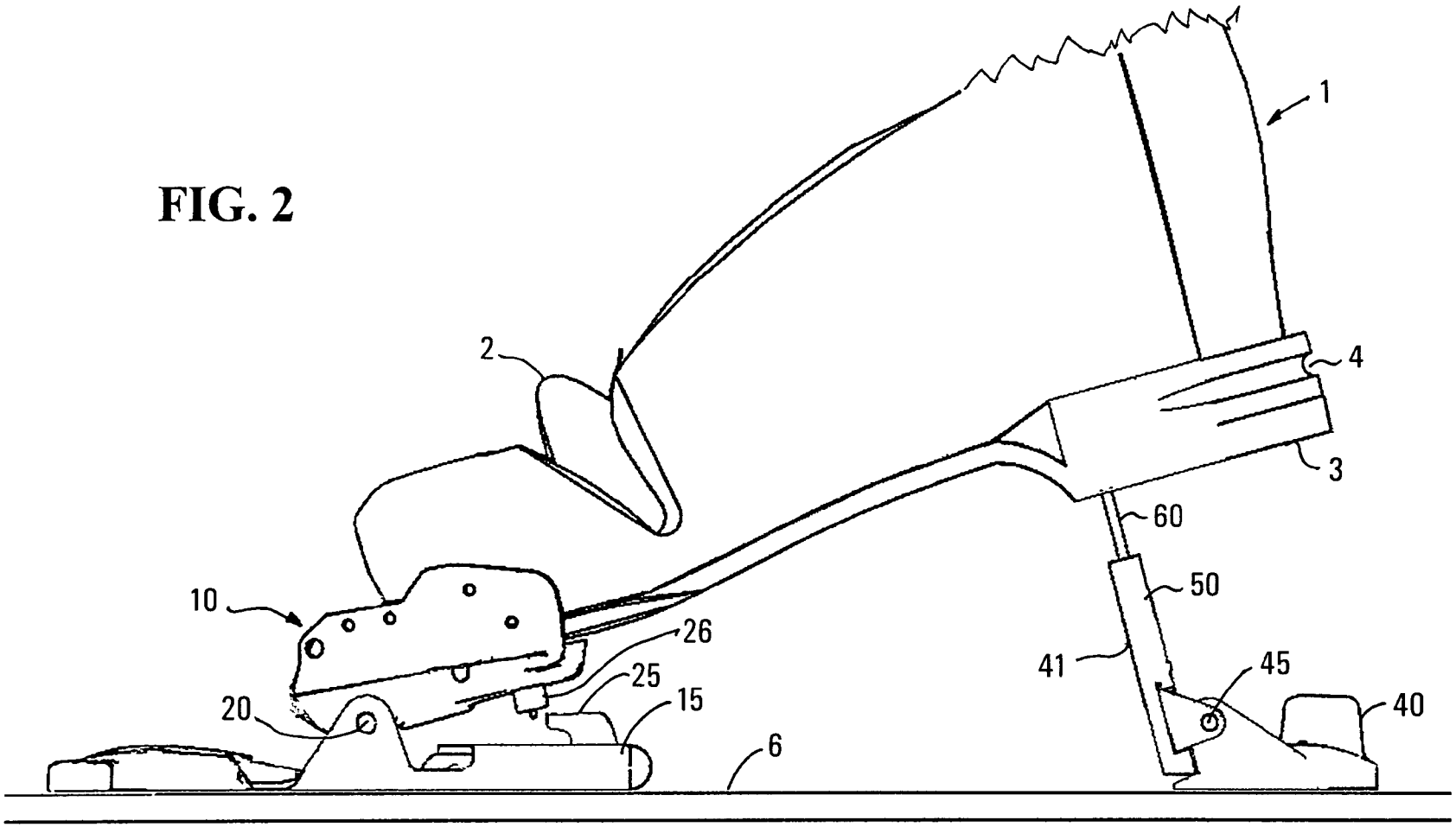
FIG. 2 is a side view showing a cut-away lower portion of a telemark boot engaged with a binding of this invention.

FIG. 2 shows a cut-away lower portion of a telemark boot 1 engaged with a binding of this invention comprising toe piece 10 which is pivotally engaged to base plate 15. The base plate, rather than the toe piece is fixed to upper ski surface denoted by line 6. Bellows 2 provides for flex of the boot in the metatarsal region, which allows boot heel 3 to be raised and lowered relative to ski surface 6 when toe piece 10 is not permitted to pivot relative to ski surface 6 when in the ski mode. When toe piece 10 is in the touring mode and is free to pivot relative to the ski surface, boot heel 3 may be more easily raised or lowered, which facilitates walking and climbing. The boot toe is retained within toe piece 10 by any of a variety of known means for engaging a telemark boot with a telemark ski binding. Such means may include plate 12 and a cable and spring assembly as shown in FIG. 1. The pivoting binding of this invention may also be used with any known means such as tabs, pins, cables, springs, stops, etc., which can be used to hold the boot toe in engagement with the toe piece. A binding of this invention may also be used with any boot heel locator, heel lifter, or heel resting device known in the art, as well as with the heel lifter embodiments described herein.

FIG. 2 shows heel lifter 40 in the open position such that optional bail 60 and body 50 extend upwards from ski surface 6 to prevent boot heel 3 being lowered to the ski surface. In this position, the boot heel is held above the ski which facilitates walking uphill on steep gradients. Heel lifter 40 is designed such that body 50 may be rotated rearward and toward the ski surface on pivot 45 to the closed position to provide surface 41 (FIG. 3) for the boot heel 3 to rest upon during touring that does not involve steep uphill gradients and during downhill maneuvers.

When the boot heel is allowed to come to rest on ski surface 6 or just above, such as on surface 41 or lifter 40, toe piece 10 will be relatively close to ski surface 6 and latch 26 (FIG. 1) will come to rest on base plate 15, helping distribute the user's weight through the base plate to the ski surface. In the latter position, receiver 25 may be moved to engage latch 26 thereby locking the toe piece relative to ski surface 6 and preventing pivotal movement of the binding. This ski mode facilitates performance of downhill maneuvers.

Figure 4:
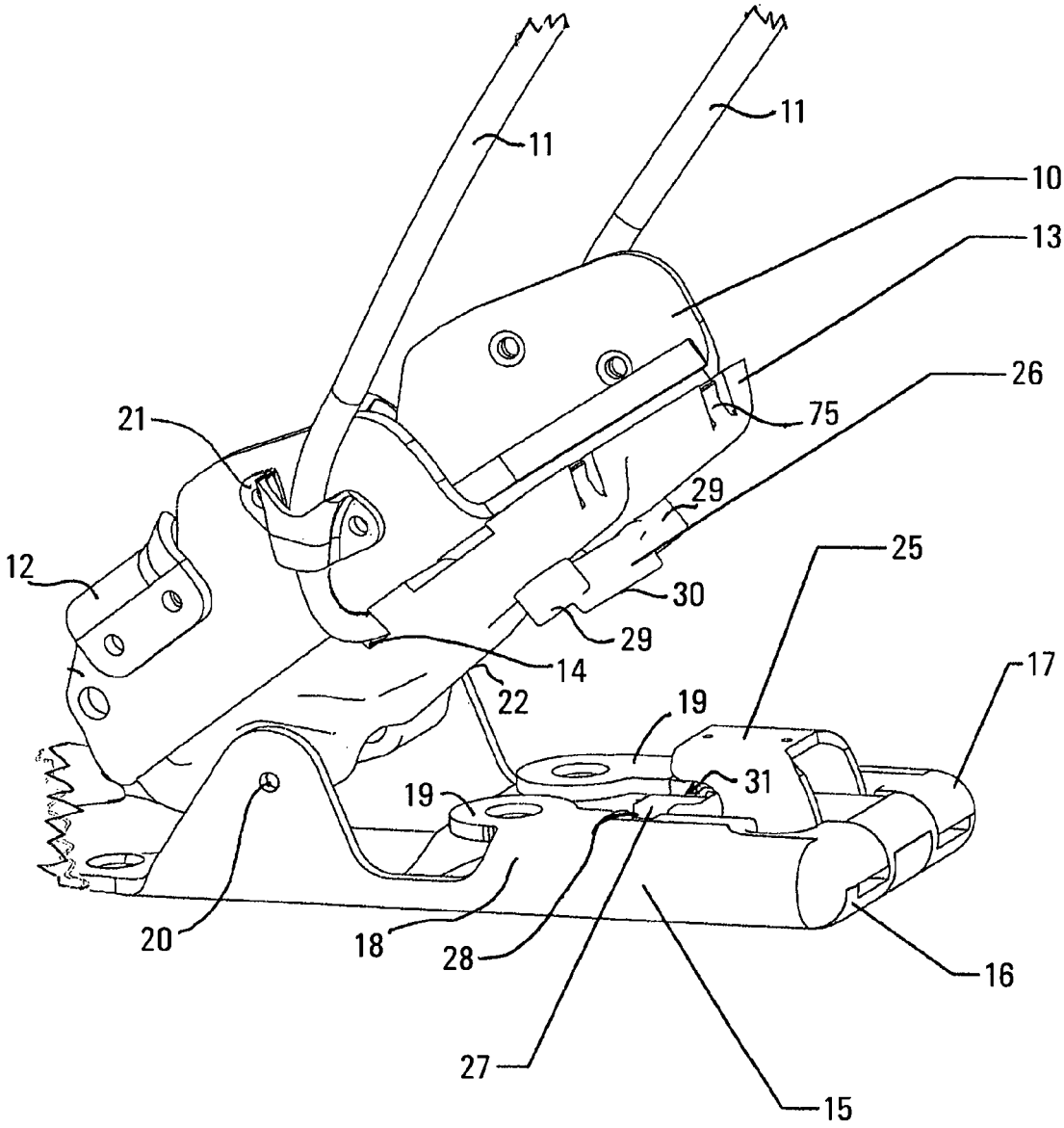
FIG. 4 is a perspective view of a portion of a binding of this invention.

Referring to FIG. 4, toe piece 10 will typically be made from a metallic material such as stainless steel or aluminum or a plastic material and may include plate 12 which engages the upper surface of the toe of the boot sole and prevents the toe of the boot from translating upward from the toe piece. In this embodiment, portions of cable 11 are shown engaged within cable guides 21 placed on opposite sides of toe piece 10. The cable may be continuous, extending beneath toe piece 10. In the illustrated embodiment, toe piece 10 is attached by fastening means (not shown) to pivot body 13 containing cutaway portion 14 through which cable 11 extends. Attachment of the toe piece 10 to pivot body 13 retains the cable on the binding. Pivot body 13 is pivotally engaged to base plate 15 at pivot 20. Extending through pivot body 13 and attached to the underside of toe piece 10 by means of suitable fasteners (not shown) is latch 26. Latch 26 may be a generally "U" or "H" shaped element comprising spaced-apart posts 29 connected by bar or web 30. The undersurface of pivot body 22 may have a wedge profile in end view. The tip of the wedge forms ridge 23. Such a profile helps push snow and ice away when the binding is pivoted downward.

In the embodiment shown in FIG. 4, base plate 15 comprises sidewalls 18 which are formed so as to provide upper base-plate surfaces 19 forming a channel within which lower and upper bearing assemblies (16 & 17, respectively) are engaged. The bearing assemblies guide a locking mechanism which includes receiver 25, which is adapted to slide fore and aft so as to engage and disengage bar 30. In this embodiment, receiver 25 has a forward oriented portion defining cavity 31 into which bar 30 will engage when the toe piece is in the locked position.

Between sidewalls 18 and formed within upper bearing assembly 17 is cavity 28 adapted to closely receive the lower portion of bar 30 when the toe piece is lowered. This engagement provides additional stability for the toe piece during aggressive maneuvers. The lower portion of bar 30 may have a narrowed or wedge profile in end view. Such a profile will help dislodge snow or ice, which may accumulate in the base plate. In the lowered position, lower surfaces of posts 29 rest on upper surfaces 19 of base plate 15 thereby translating the weight of the skier from the toe piece to the base plate and the ski itself. Small posts, nubs, or points may be formed in surface 19. The presence of such an element or elements can help prevent ice build up on surface 19, as ice or snow is dislodged by contact of the elements with the lower surface of posts 29. Latch 26 is a substantial element which serves to both stabilize the toe piece when lowered and to provide a strong locking element for retaining the toe piece in the lowered position. Resilient dampening member 27 is situated within cavity 28.

Figure 5:
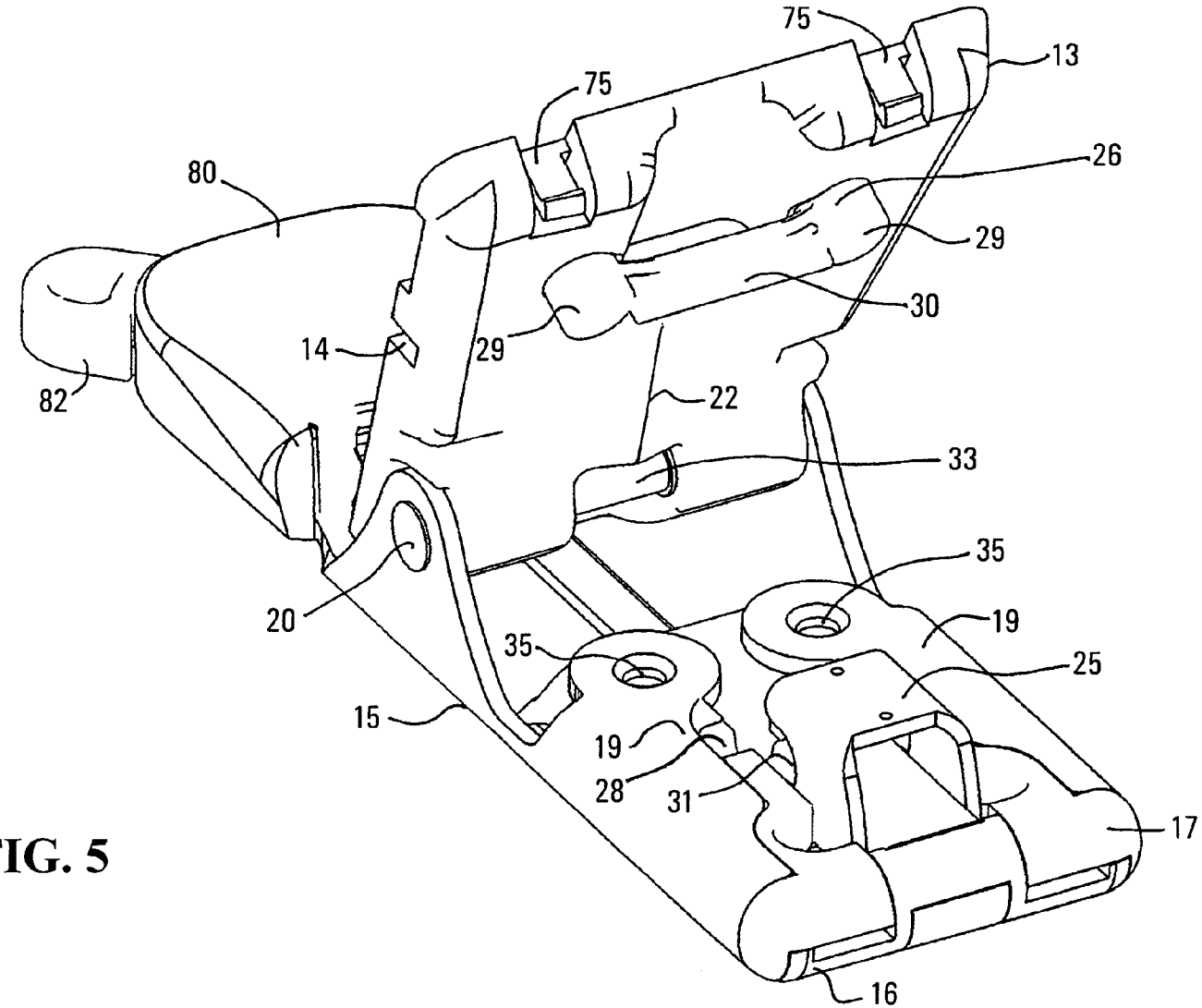
FIG. 5 is a perspective view of a pivot body and base plate of a binding of this invention.

FIG. 5 is a different perspective view of some of the binding components. Toe piece 10 and cable 11 are removable and are absent in this drawing. Latch 26 has been removed from the toe piece and is shown still engaged within channels in pivot body 13 through which posts 29 would extend to the undersurface of toe piece 10, when the toe piece is present. Axle 33 of pivot 20 is shown. Holes 35 are present in upper surface 19 for receiving suitable fasteners for attaching base plate 15 to the upper surface of a ski. Preferably, corresponding through-holes are provided in upper and lower bearing assemblies 17 and 16 for receiving the same fasteners. Removable front cover 80 is shown, as is locking mechanism actuator tab 82. Spring clips 75 for receiving the rearward portion of an optional ski crampon are also shown and are further described below.

Figure 6A:
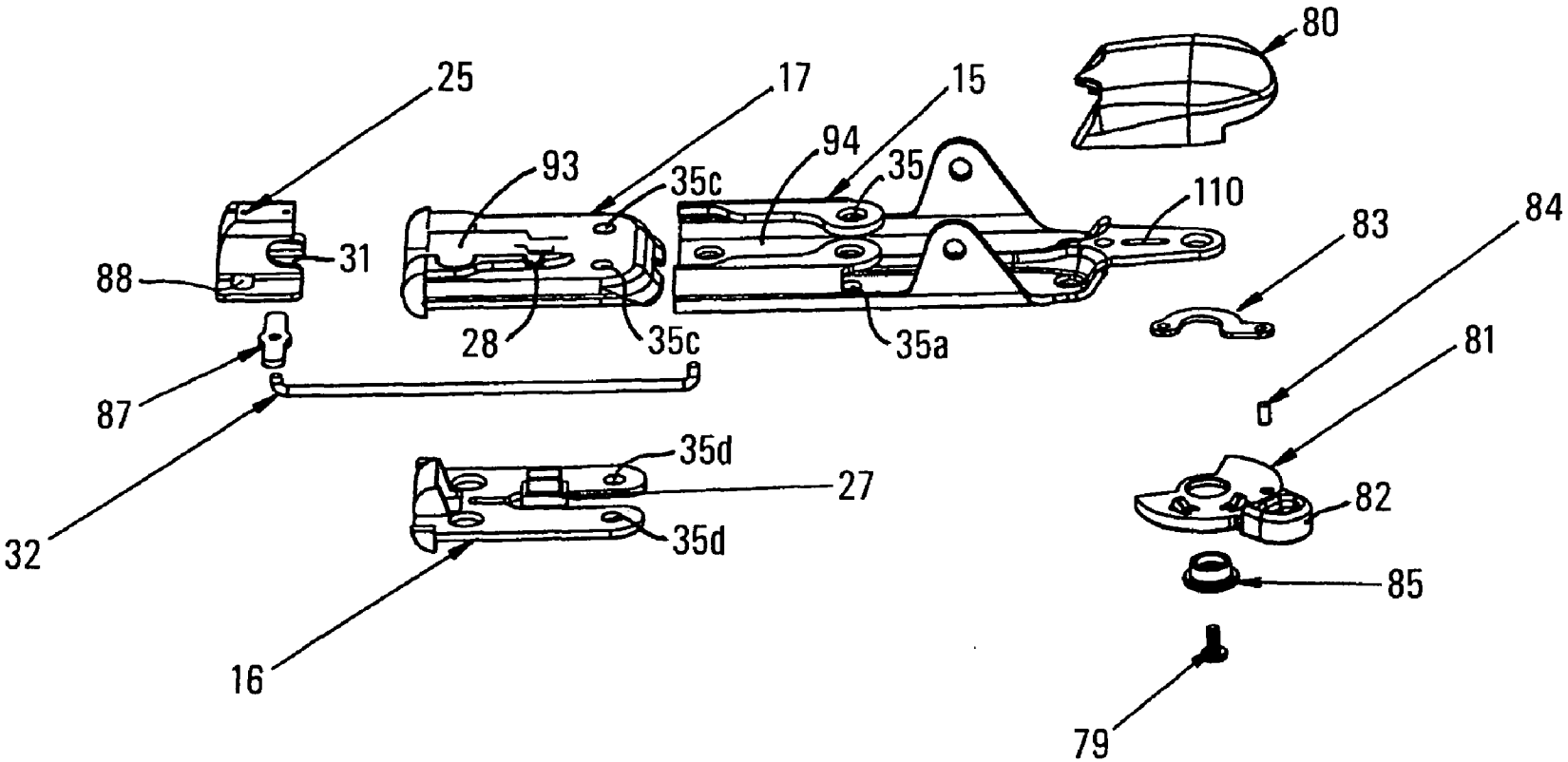
FIGS. 6A and 6B are exploded views of a binding of this invention.
Figure 6B:
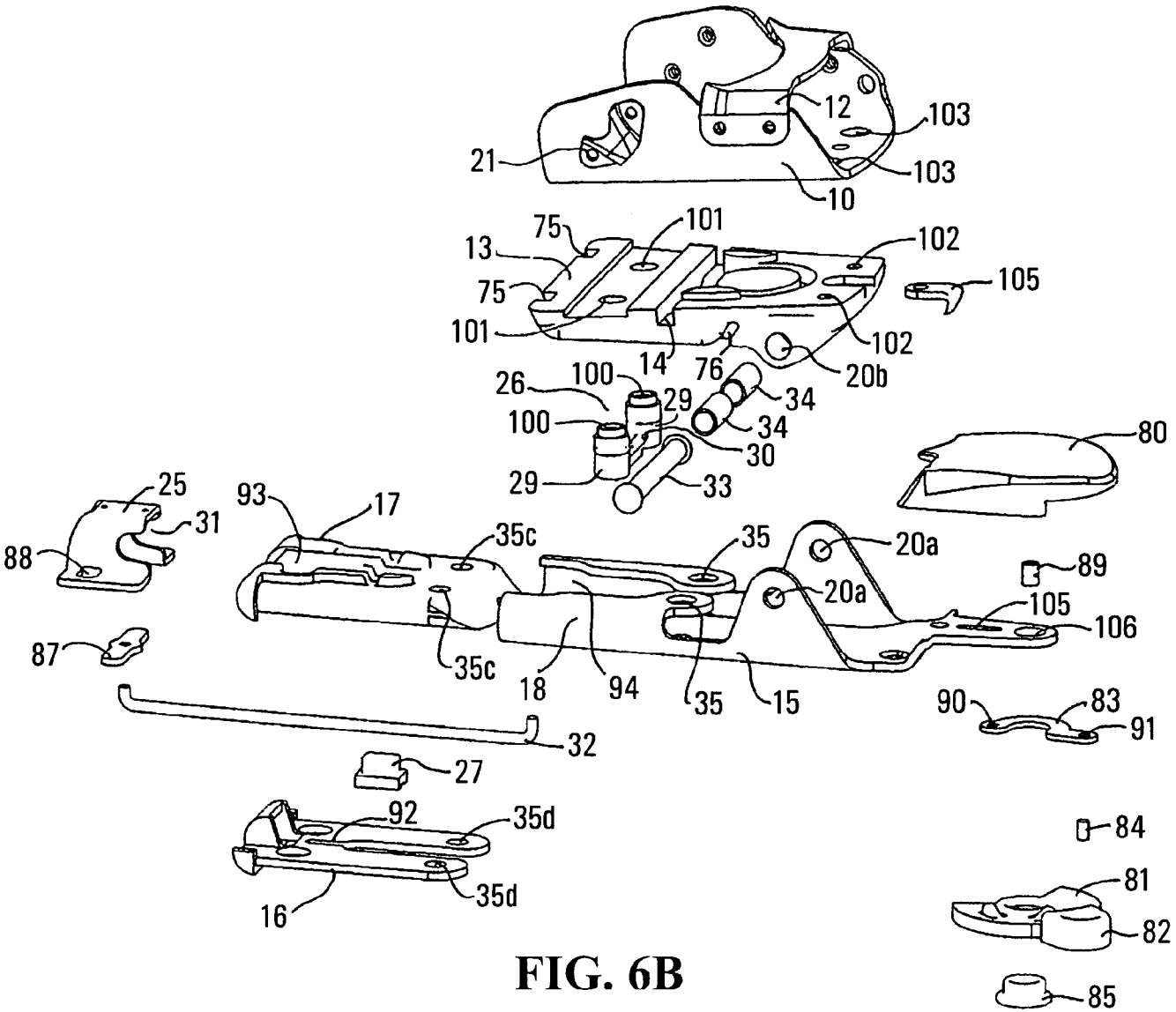

FIGS. 6A & 6B are exploded views of components shown in the preceding drawings. Toe piece 10 and pivot body 13 are not included in the view shown in FIG. 6A.

Toe piece 10 as illustrated includes typical boot toe retention means (plate 12) and cable guides 21 which may be of the kind employed on any commercially available telemark toe piece. The toe piece may further include other components used in telemark toe pieces such as snow shedding plastic plates, anti-friction plating, etc. This embodiment allows for interchangeability of the toe piece since it may be removably fastened to pivot body 13. This is typically done by means of suitable fasteners placed in through holes 103 of toe piece 10 with the fasteners being engaged in corresponding holes 102 of pivot body 13. Threaded fasteners such as screws may be employed. Preferably, pivot body 13 is made from a suitable plastic material which can receive screws. Nevertheless, pivot body 13 may be made from any suitable material. Grooves 76 may be placed on either side of pivot body 13 for receiving a ski crampon. Pivot body 13 may contain a cylindrical channel 20*b* which corresponds with pivot channel 20*a* in base plate 15. Channel 20*b* receives bearings 34 in which axle 33 is recessed. Axle 33 engages with channels 20*a* of base plate 15. Element 105 fastened to pivot body 13 may be included to provide a place for attachment of a safety cable, runaway strap or the like, or element 105 may be a resilient "bumper".

Upper portions of posts 29 of latch 26 contain threaded holes 100 for receiving threaded fasteners used to attach the latch to the underside of toe piece 10. In this embodiment, upper portions of posts 29 are placed in through-holes 101 of pivot body 13.

Sidewalls 18 of base plate 15 define a channel 94 adapted to receive lower and upper bearing assemblies 16 & 17. In combination, these bearing assemblies are inserted from the rear of base plate 15 into channel 94. Prior to insertion, receiver 25 is placed on lower bearing assembly 16 at 92 and upper bearing assembly 17 is then engaged thereon such that the upper portion of receiver 25 will be situated in channel 93 of upper base plate 17. A lower portion of receiver 25 contains cutaway portion(s) 88 which receives flange 87 having means for attachment to connecting link 86. Connecting link 86 runs under the binding to the front portion of base plate 15 where cover 80 may be attached.

Dampening member 27, typically made from a resilient natural or synthetic polymeric or elastomeric material (such as rubber or urethane) is placed on lower bearing element 16 as shown in FIG. 6A. Thus, dampening member 27 and receiver 25 are "sandwiched" between upper and lower bearing assemblies 17 & 16 when the bearing assemblies are placed in channel 94. Receiver 25 will slide along an upper surface of lower bearing assembly 16 when actuated by connecting link 86.

Dampening member 27 may be any resilient means, including a spring actuated mechanism and is dimensioned such that an upper surface of the member will come into contact with a lower surface of bar 30 just before posts 29 contact upper surface 19 of base plate 15 when the binding is pivoted downwards. When posts 29 come to rest on surfaces 19, dampening member 27 will then be under compression. Compression of the resilient dampening member serves to eliminate or reduce rattle, clicking, or other sounds which may result from vibration causing bar 30 to intermittently contact receiver 25. Such noise is distracting to the user when executing maneuvers as it may give the sense that the binding has become loose.

Shown in FIGS. 6A & 6B are through holes 35*c* & 35*d* of the bearing assemblies which correspond to holes 35 of base plate 15. Suitable fasteners may be placed through these corresponding holes and into the upper surface of a ski.

Cover 80 is removable and is intended to protect an eccentric mechanism for operating the locking mechanism via connecting link 86. Forward end of connecting link 86 is engaged in hole 90 of a "C"-shaped linkage 83 which is pivotally mounted via pin 84 to rotational element 81 which comprises actuator tab 82. Tab 82 extends beyond cover 80 in the assembled state. Rotational element 81 is supported by cylindrical bearing 85 which engages hole 106 at the front of base plate 15. This assembly is retained on base plate 15 by means of a threaded fastener 79 which extends through bearing 85 to engage threaded fastener retention means 89.

FIGS. 7A-7C are different views which show the locking mechanism actuator means illustrated in the preceding drawings. FIG. 7A is a top view of the front portion of the toe piece with cover 80 installed. Actuator tab 82 is placed at the front of the binding over the ski and is thus easily reached by the user and is less likely to suffer damage from the other ski or objects in the snow. The user may operate the locking mechanism of this binding by moving the actuator tab in a semicircular motion from left to right or vice versa. FIG. 7B shows the underside of the binding assembly as illustrated in FIG. 7A. Flange 87 to which the rearward end of connecting link 86 is attached is shown through a key-way on the underside of base plate 15. Key-way 110 in the front end of base plate 15 receives the forward end of the connecting rod as shown in FIG. 7C which is a top view of the front portion of the binding with cover 80 removed. C-shaped linkage 83 provides an "over-center" locking mechanism when rotary actuator 81 is turned, translating the rotary action to a linear action via connecting link 86. The over-center mechanism provides resistance to the rotation of rotary actuator 81, unless deliberately carried out by the user.

Base plate 15 may be constructed from any suitable material, including aluminum stainless steel, or a rigid plastic, although metal is preferred. Likewise, the upper and lower bearing assemblies may be made from any or all of these materials. It may be advantageous to have the lower bearing assembly 16 comprise at least a metallic surface to minimize wear from receiver 25, whereas upper bearing assembly 17 may be advantageously made from a plastic material. The same is true of the actuator mechanisms, although the bearings, pins, connecting links and the like are advantageously made of a suitable metal. Pivot components are preferably metallic although bearings may be metallic or made from a plastic material. Latch 26 and receiver 25 are preferably metallic but may be made from any suitable material.

The configuration of latch 26 may vary, although it would preferably be comprised of at least two spaced-apart posts (which may be cylindrical, square, or have another profile in cross-section) to support the skier's weight. Bar 30 may have any profile in cross-section (round, square, etc.) and may be a web extending between posts 29. Preferably, latch 26 is oriented such that the spaced-apart posts are situated on opposite sides of the toe piece to better distribute the user's weight.

The locking mechanism, including receiver 25 may take a variety of forms, including the hook shaped receiver illustrated herein. This receiver may be oriented for engagement with latch 26 by movement in either a forward or rearward direction relative to an axis of the ski. Depending upon the profile of bar 30 relative to posts 29, a sideways action of receiver 25 could be employed for engagement of bar 30. Receiver 25 may slide parallel to the ski surface or may follow an upwardly oriented arcuate path to provide additional clamping engagement of bar 30. Suitable receivers for use in this invention may have a variety of profiles in addition to the hook-shaped profile illustrated herein for receiver 25. Also, the receiver could be adapted to rotate in order to engage latch 26. In other embodiments, the receiver may contain an angled or ramp shaped element for engagement with bar 30 and it may contain a plurality of such elements. For example, the elements may be conical in shape providing increased downwards force on bar 30 as the locking mechanism is engaged.

Fasteners for use with this invention may be any of a variety of suitable fastening means. The embodiments of this invention as illustrated are particularly suited for the use of screw fasteners. However, other threaded fasteners may be employed such as nut/bolt arrangements. Rivets may be employed in portions of the apparatus that are not intended to be readily separated for repair or replacement of parts.

Figure 3:
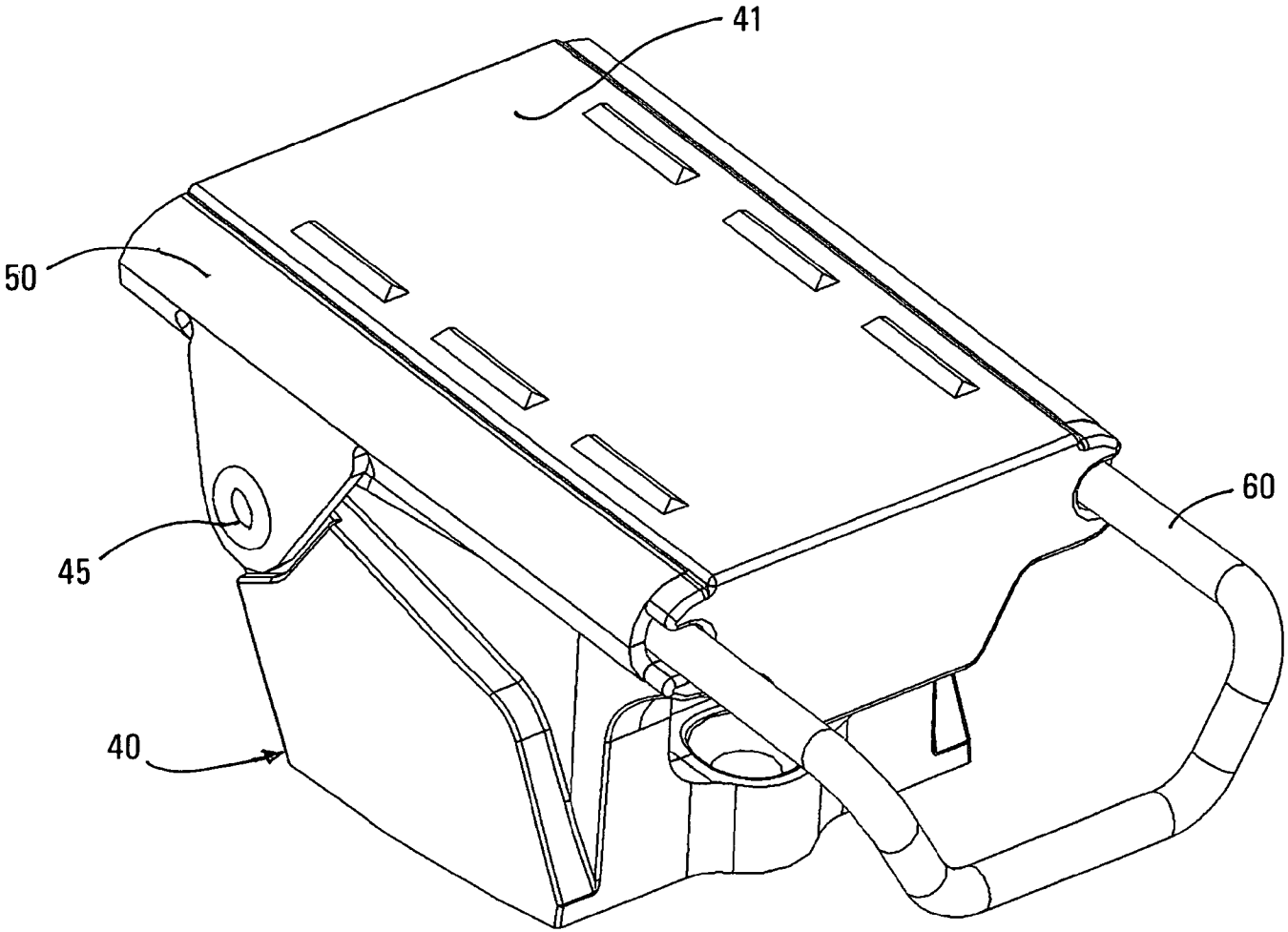
FIG. 3 is a perspective view of a heel lifter of this invention in a collapsed position.
Figure 8A:
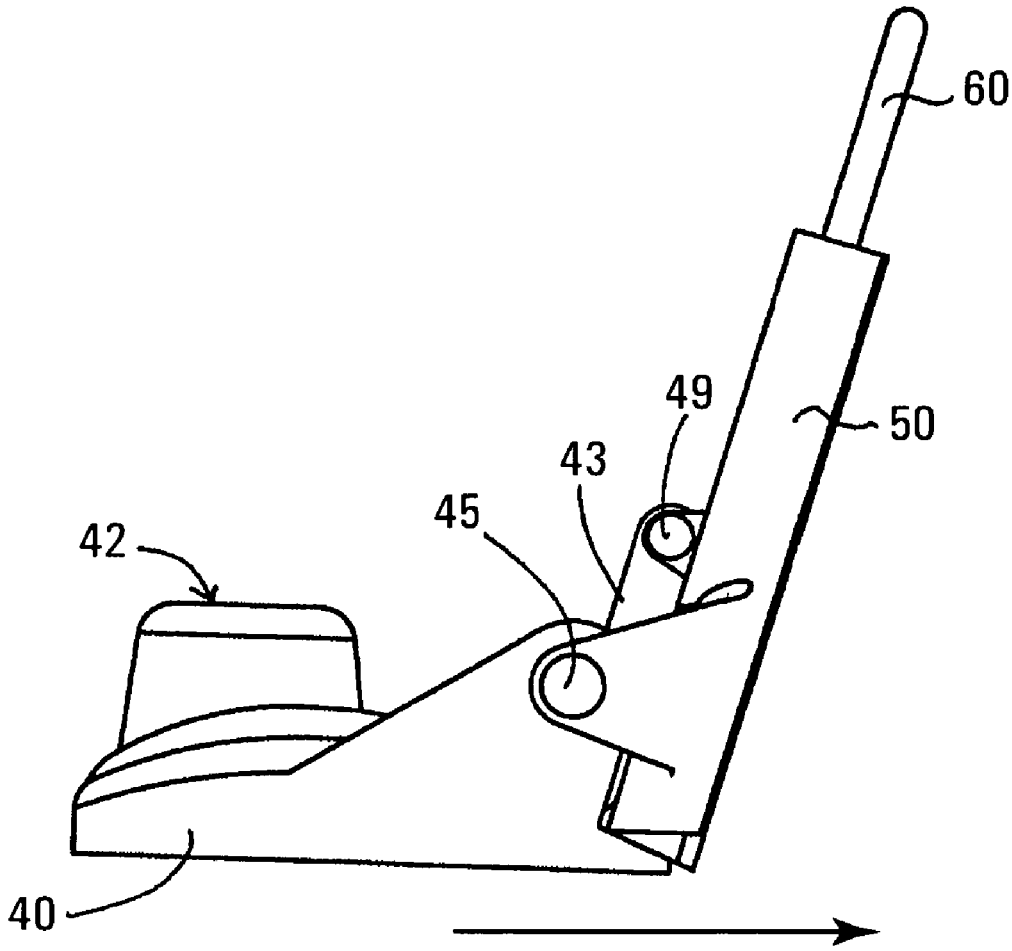
FIGS. 8A and 8B are side views of a heel lifter of this invention in extended modes.
Figure 8B:
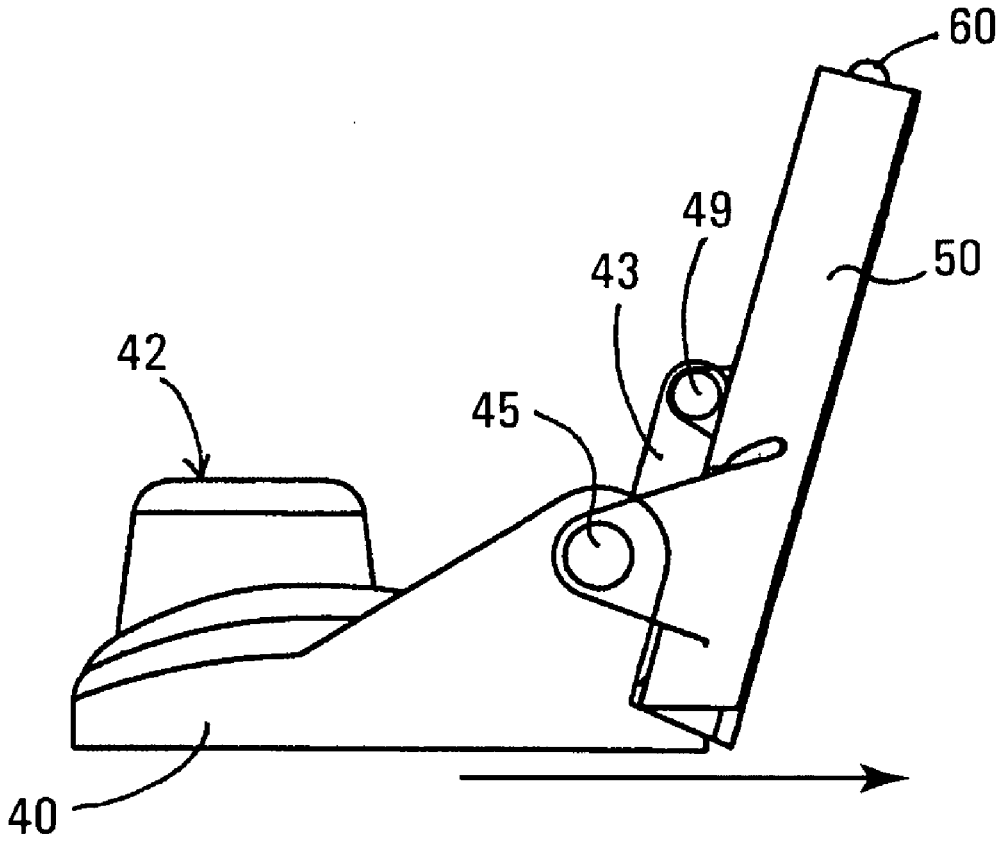
Figure 8C:
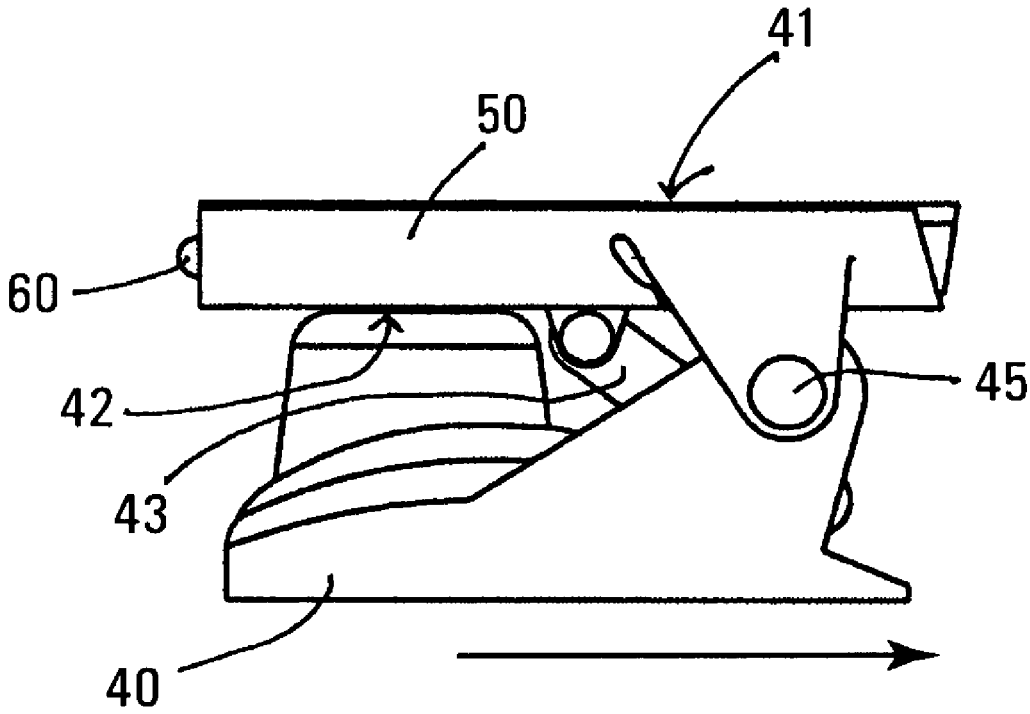
FIG. 8C is a side view of a heel lifter of this invention in a collapsed position.

FIGS. 8A-8C show a heel lifter 40 of the kind shown in FIGS. 2 and 3. The arrow in each of these drawings points in the direction of the ski tip to show the proper orientation of the heel lifter when mounted on a ski surface. FIG. 8A shows the lifter in an optional, extended mode for steep hill climbing. FIG. 8B shows the lifter in an extended mode for less severe hill climbing and FIG. 8C shows the lifter in a retracted mode for normal travel and downhill skiing. Bail 60 is an optional component intended to be slidably engaged within body 50 to provide for differential amounts of heel lift as shown in FIGS. 8A and 8B. Body 50 is pivotally engaged to a base plate adapted to be secured to the ski surface. In the lowered position shown in FIG. 8C, body 50 comes to rest at surface 42 and the weight of the user is translated through the device to the ski. The device is typically mounted to the surface of the ski by means of threaded fasteners extending through the base plate.

As shown in FIGS. 8A and 8B, when in extended position, body 50 is over-center and rests at an angle extending upwards and towards the tip of the ski. This prevents the device from returning to the collapsed position when the skier's weight is placed on bail 60. Linear resilient element 43 is pivotally attached at 49 to body 50 provides tension which tends to retain the device in either the extended position shown in FIGS. 8A and 8B or the collapsed position in FIG. 8C. However, because of the use of the over-center configuration in the extended position, resilient element 43 is not relied upon to retain the device in the extended position with the user's weight applied to the device. Thus, the amount of tension provided by resilient element 43 need only be enough to minimize accidental movement of the device (for example when hit with a ski pole) and to cause the device to "flip" into the extended or collapsed position when prompted by the user. Suitably, resilient element 43 may be an elastomeric member or a linear spring.

Figure 9:
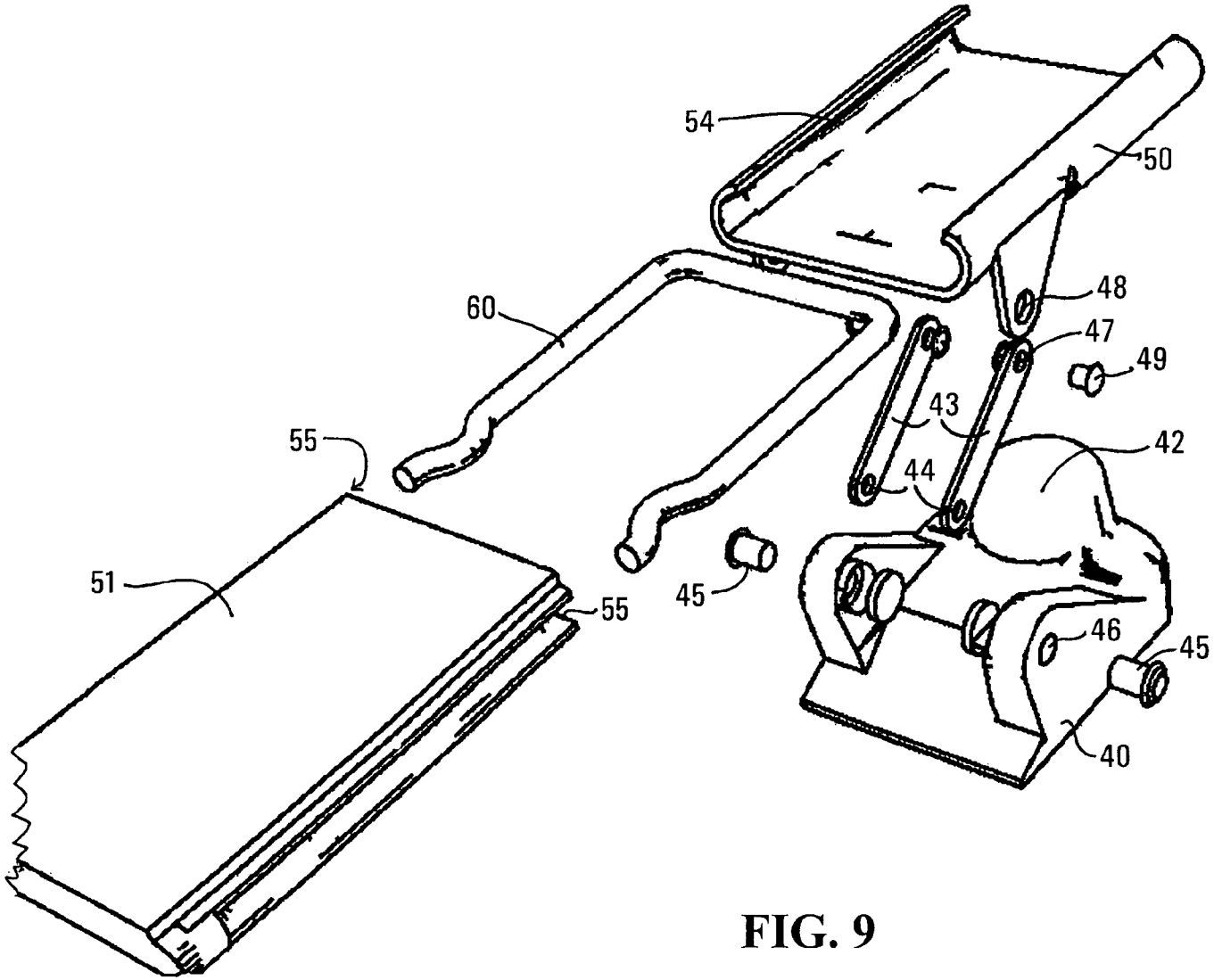
FIG. 9 is an exploded view of the heel device shown in FIGS. 8A-8C. Retainer 51 is shown partially cut-away.

Referring to FIG. 9, there are a plurality of resilient elements 43 pivotally mounted to body 50 by means of a pin 49 extending through holes 47 and 48 in the resilient element and the body, respectively. Opposite ends of resilient elements 43 are pivotally engaged to the remainder of the device by means of pins 45 extending through holes 44 and 46 in the resilient element 43 and the device, respectively. Body 50 comprises generally C-shaped sidewalls and is open along one side to define cavity 54. Inserted in cavity 54 is retainer 51 and bail 60. Bail 60 is engaged on retainer 51 by pressing it into corresponding side grooves 55 on retainer 51. This entire assembly is then slid into cavity 54 of body 50.

Figure 10:
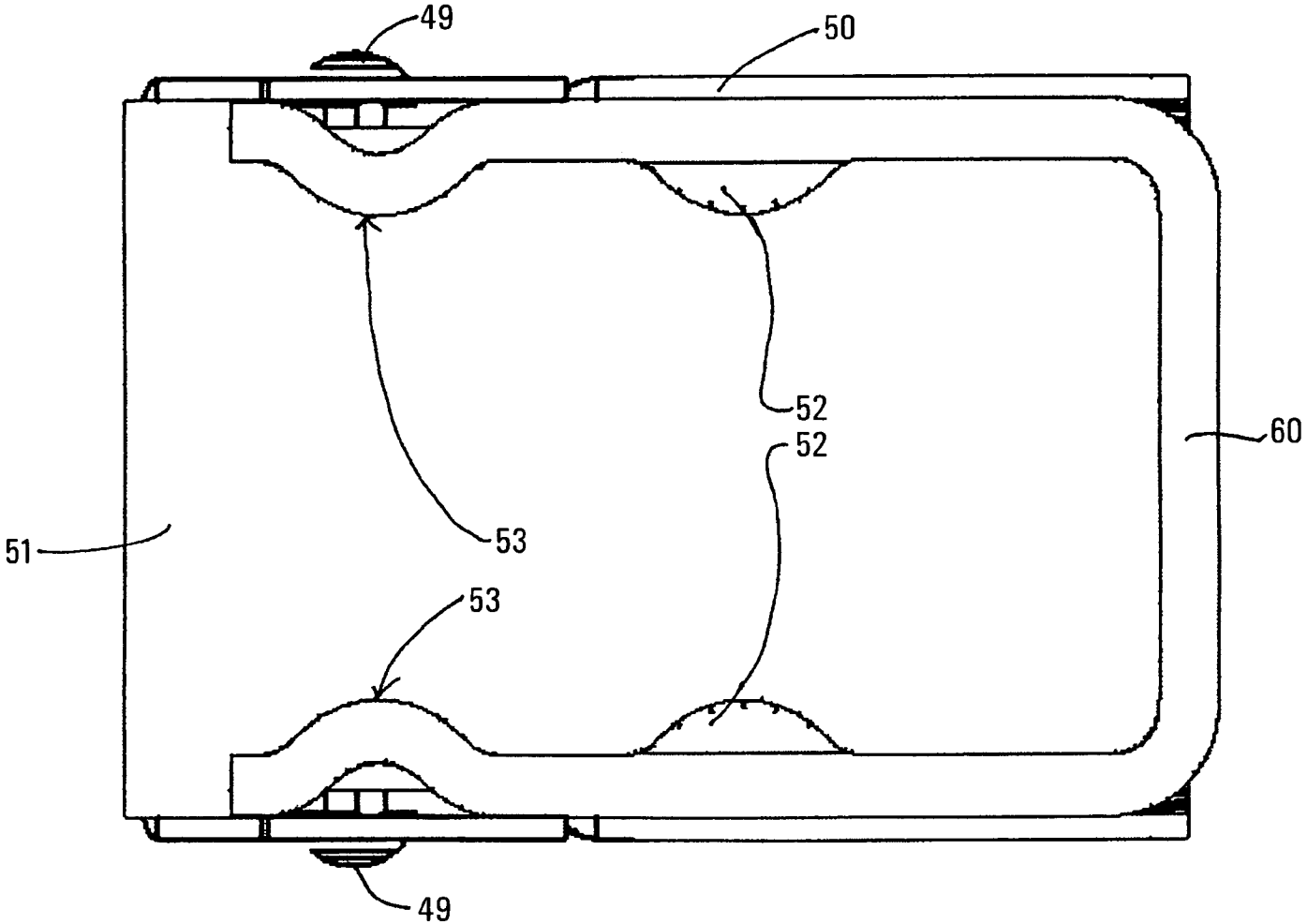
FIG. 10 is a top view of a heel lifter of this invention in collapsed orientation.

FIG. 10 shows the aforementioned heel device shown in a collapsed orientation such as is illustrated in FIG. 8C. Retainer 51 is shown in a "cut-away" view with one surface thereof removed along a plane defined by side grooves 55 thereby exposing bail 60 and internal depressions 52 and 53 adapted to receive corresponding C-shaped bends in bail 60. Engagement of the bent portions of the bail in depressions 52 or 53 tends to retain the bail in either an extended or retracted position as shown in FIGS. 8A and 8B.

Figure 11:
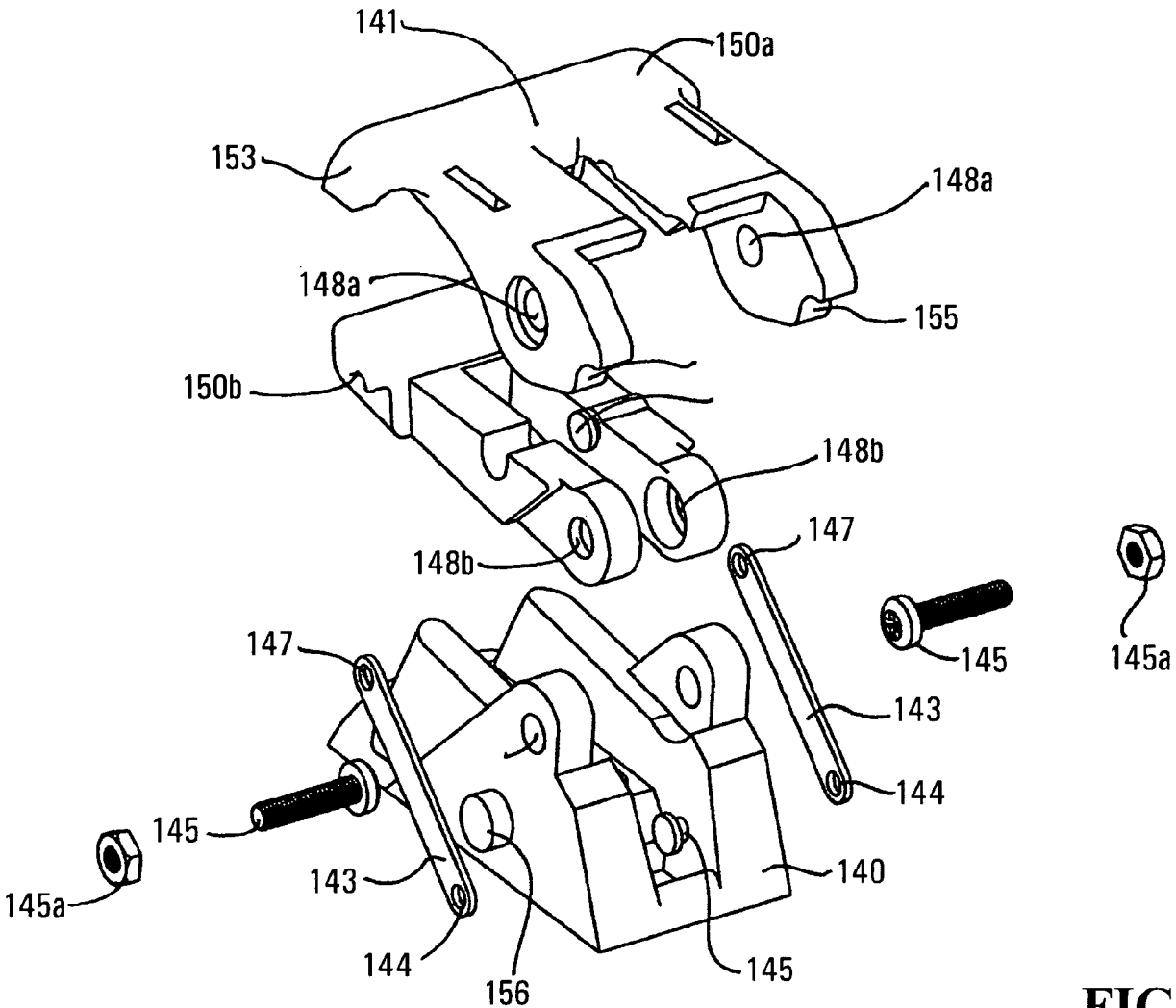
FIG. 11 is an exploded view of an alternate heel lifter of this invention.

FIG. 11 shows an alternate heel lifter which makes use of multiple resilient elements 143, each separately tensioning one of a plurality of heel support elements 150*a* and 150*b*. In this embodiment, heel lifting elements 150*a* and 150*b* do not contain an adjustable element since the two support elements are of different lengths to provide different amounts of elevation of a boot heel. The same "over-center" arrangement is used such that the user's weight will hold the device in the elevated position and the amount of tension provided by resilient elements 143 need only be sufficient to urge the device to either a collapsed state or the extended state.

Figure 12A:
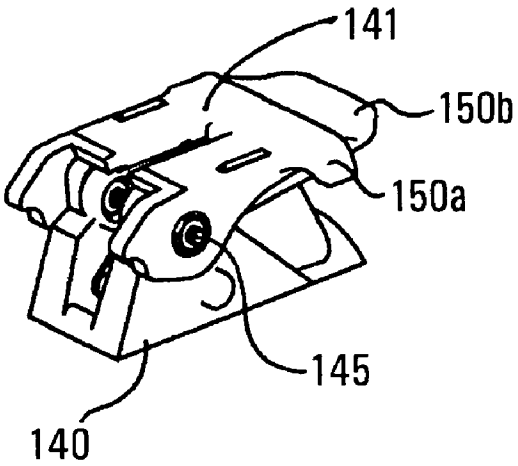
FIGS. 12A and 12B are perspective and side views, respectively, of the heel lifter shown in FIG. 11.
Figure 12B:
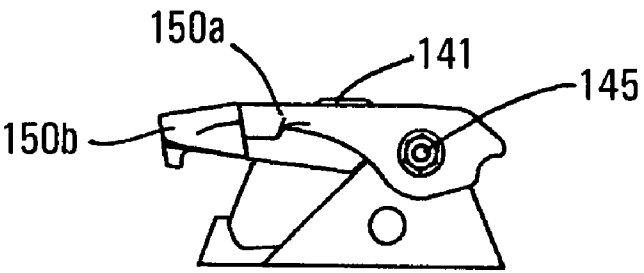

FIGS. 12A and 12B are different views showing the latter embodiment of the heel lifter device in a collapsed state with surface 141 available for resting the boot heel during normal travel and downhill maneuvers.

Figure 13A:
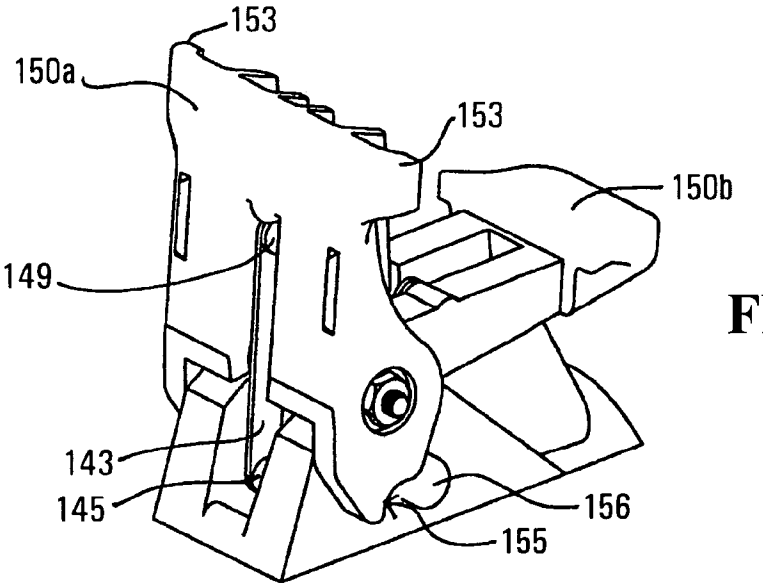
FIGS. 13A and 13B are perspective and side views, respectively, of the heel lifter shown in FIG. 11.
Figure 13B:
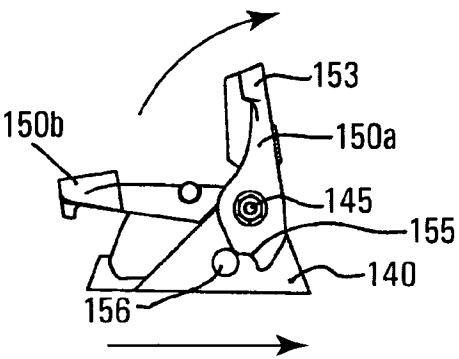

FIGS. 13A and 13B show the preceding device part way to a moderately extended position with element 150*a* extended upwards. Proper orientation of the device relative to the ski surface is shown in FIG. 13B where the straight arrow points in the direction of the ski tip. In this illustration, element 150*a* is rotated in the direction of the curved arrow until indent surface 155 comes to rest on post 156. Once in the latter position, the device will be "over-center". Tabs 153 on element 150*a* are provided to facilitate movement of the element through use of a ski pole tip.

Figure 14A:
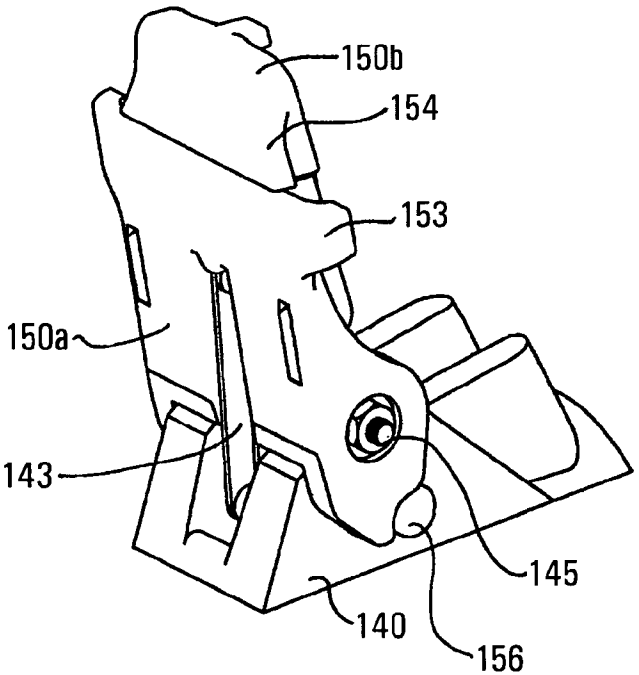
FIGS. 14A and 14B are perspective and side views of a heel lifter of this invention of the kind shown in FIG. 11.
Figure 14B:
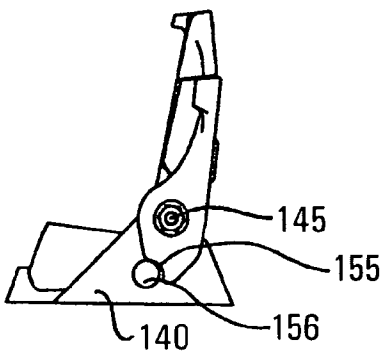
Figure 15A:
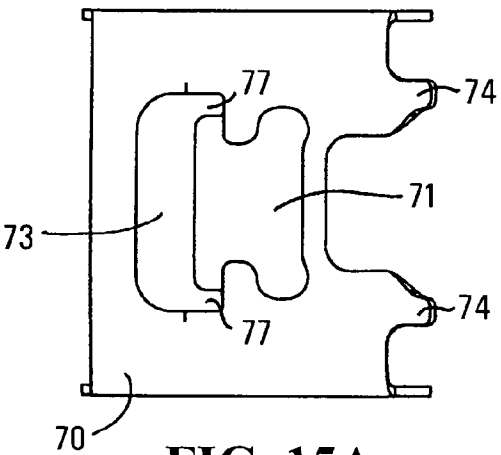
FIGS. 15A-15D are top, front end, side and perspective views, respectively, of a ski crampon of this invention.
Figure 15B:
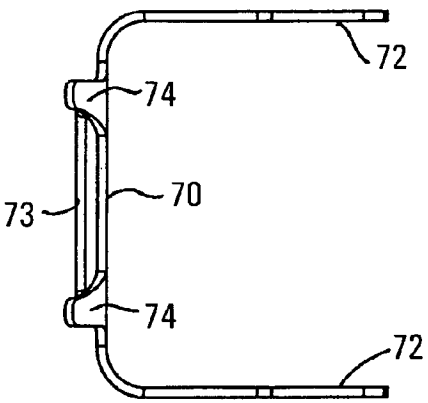
Figure 15C:
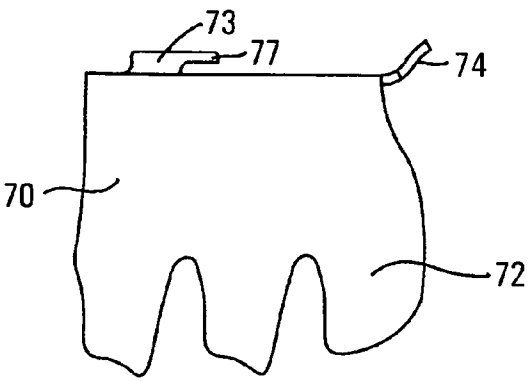
Figure 15D:
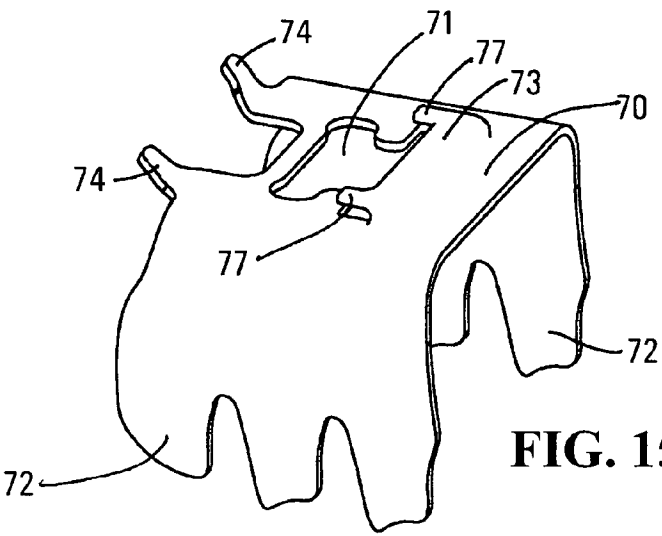

FIGS. 14A and 14B illustrate the latter device in the fully extended position where element 150*b* is extended upwards to support the heel of the user's boot. The straight arrow in FIG. 14B illustrated the direction of the ski tip. In this illustration, indent 155 has come to rest on post 156. Tabs 154 on element 150*b* facilitate movement of the latter element, for example by use of a ski pole tip.

FIGS. 15A-15D show a ski crampon 70 for use with a binding of this invention. Ski crampons typically comprise a plurality of teeth which are downwardly oriented and positioned on opposite sides of a ski for biting into hard snow and ice while climbing. In the ski crampon of this invention, teeth 72 are situated on opposite sides of the crampon. On an upper surface of crampon 70, there is a cut-away portion 71 dimensioned to receive latch 26. In use, the upper surface of crampon 70 is mounted against the undersurface of pivot body 13 of a ski binding of this invention. Latch 26 extends through cut-away portion 71 and is free to engage the locking mechanism of the binding. Tangs 74 are adapted to be inserted in corresponding grooves 76 (as shown in FIG. 6B) situated on each side of pivot body 13. Rearward tangs 77 are positioned to engage with spring clips 75 (as shown in FIG. 5 and FIG. 6B) such that the crampon is thereby retained on the undersurface of pivot body 13. Tangs 77 are placed on a raised portion 73 on the upper surface of crampon 70. Alternatively, one or more spring clips may be present on the upper surface of crampon 70 in place of tangs 77, in which case spring clips are needed on the pivot body. In this embodiment, the spring clips on the crampon will engage opposing grooves, ledges, etc. on the pivot body.

Figure 16B:
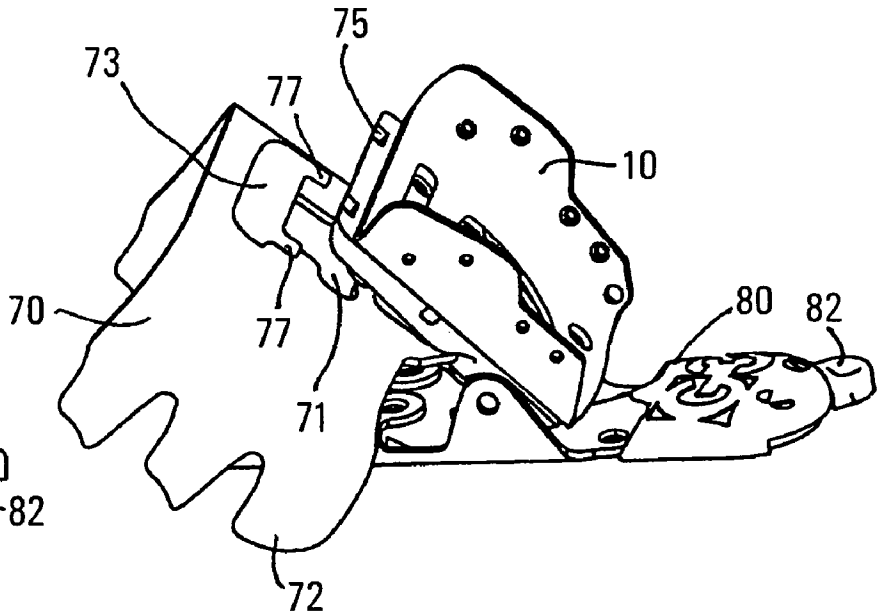
FIGS. 16A and 16B are side and perspective views, respectively, of a ski crampon of this invention being engaged with a binding of this invention.
Figure 16A:
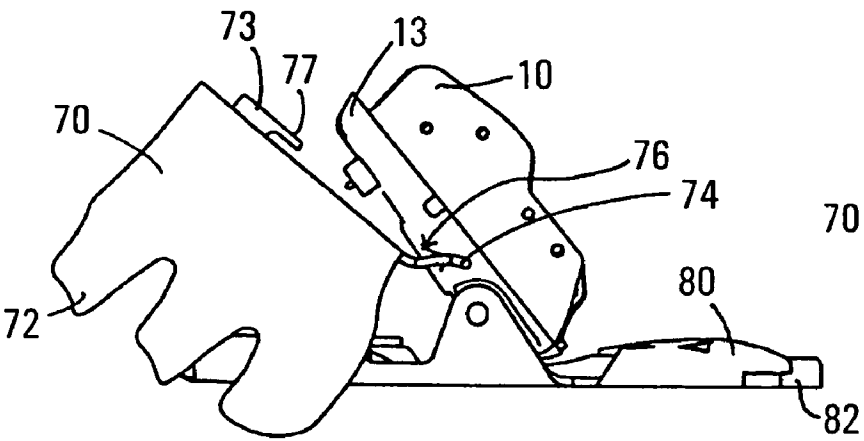

FIGS. 16A and 16B illustrate installation of the ski crampon by first inserting tangs 74 into grooves 76 and drawing the upper surface of crampon 70 towards the undersurface of pivot body 13 until tangs 77 engage spring clips 75.

Figures 17, 17A:
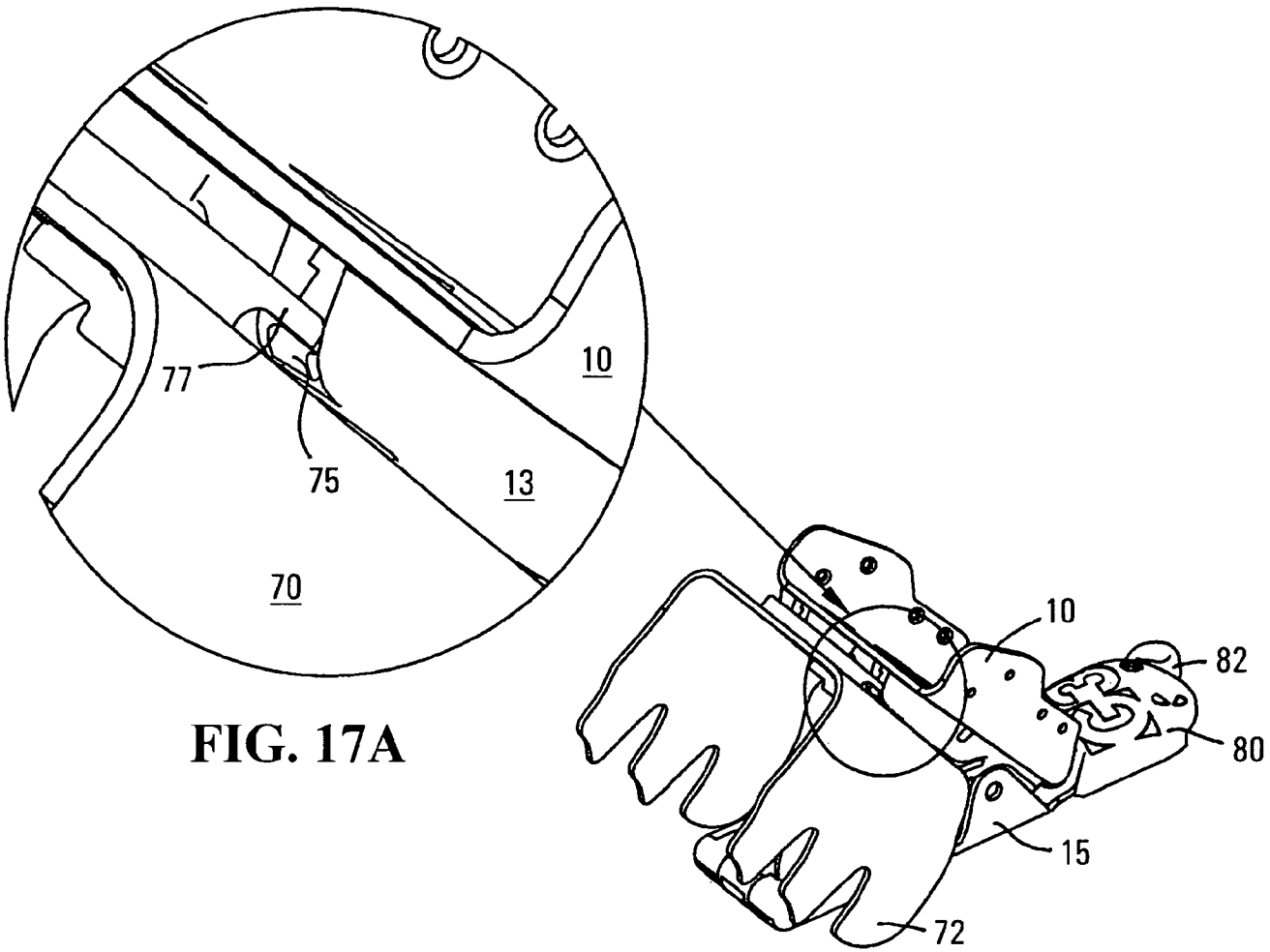
FIG. 17 is a perspective view of a ski crampon of this invention engaged with a binding.
FIG. 17A is an enlarged portion of FIG. 17.

FIG. 17 and the enlarged portion shown in FIG. 17A illustrate engagement of tangs 77 with spring clips 75.

Figure 18B:
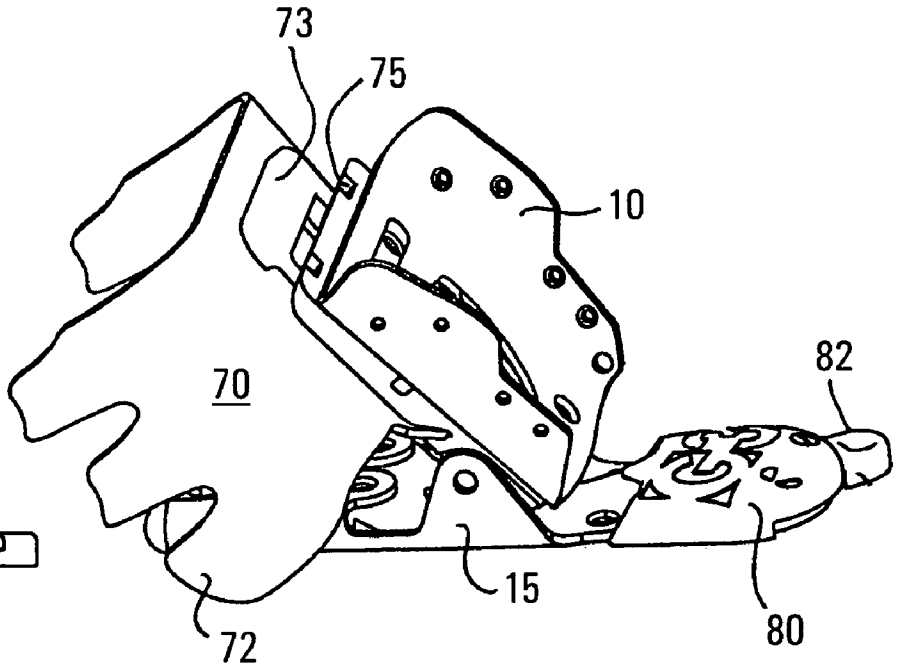
FIGS. 18A and 18B are side and perspective views, respectively, of a ski crampon engaged with a binding of this invention.
Figure 18A:
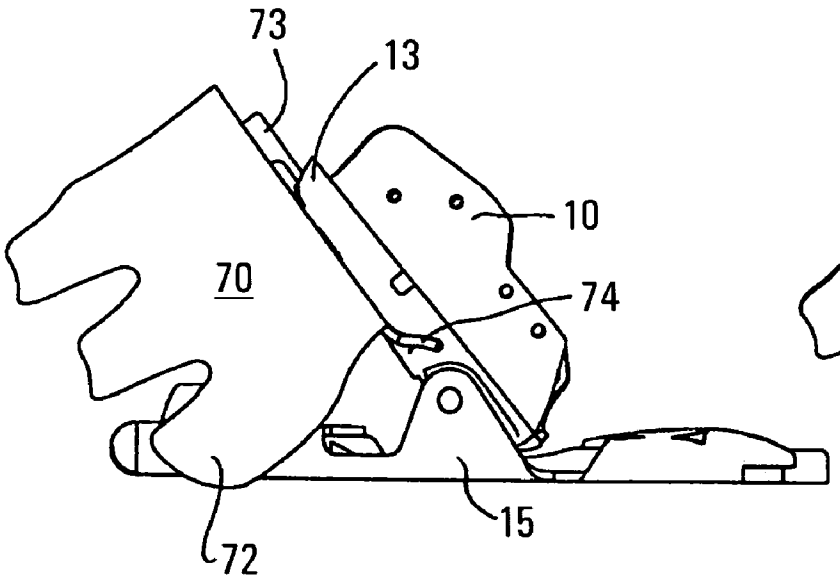

FIG. 18A (side view) and FIG. 18B (perspective view) show the installed crampon 70 on a ski binding of this invention while in tour mode.

Figure 19B:
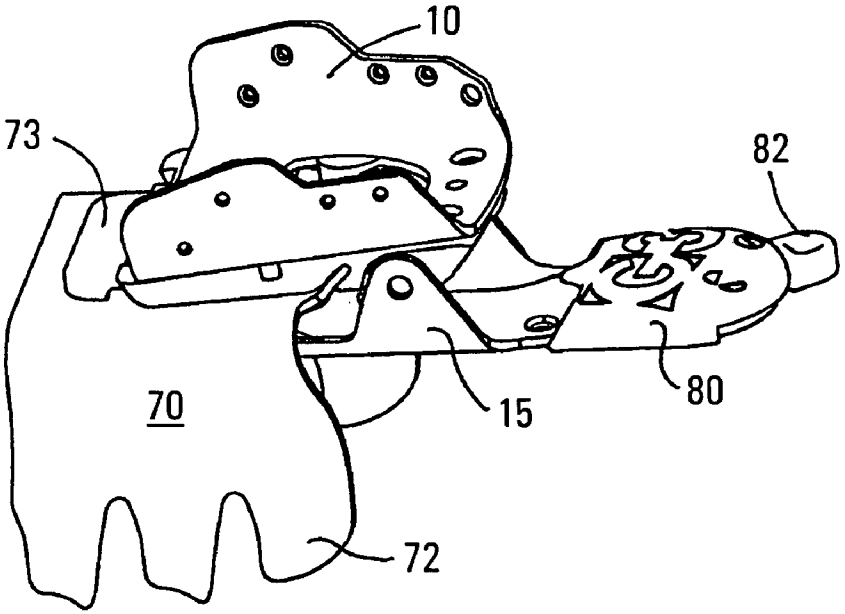
FIGS. 19A and 19B are side and perspective views, respectively, of a ski crampon engaged with a binding of this invention.
Figure 19A:
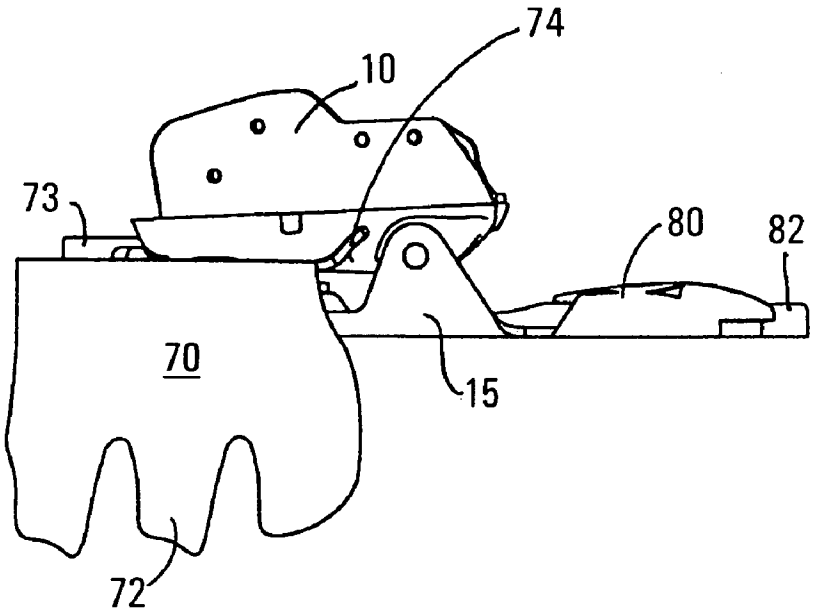

FIG. 19A and FIG. 19B illustrate crampon 70 installed on a ski binding of this invention while in the ski mode with the toe piece locked so that it cannot pivot. Positioning of the locked mechanism actuator at the front of the toe piece allows for locking to take place even while the ski crampon is installed. Provision of the cut-away 71 in the top surface of the ski crampon allows for latch 26 to reach the locking mechanism and allows for locking the binding while the ski crampon is installed. Furthermore, the stability provided by latch 26 when engaged with base plate 15 remains while the crampon is installed.

Although the foregoing invention has been described in some detail by way of illustration and example for purposes of clarity of understanding, it will be readily apparent to those of skill in the art in light of the teachings of this invention that changes and modification may be made thereto without departing from the spirit or scope of the invention described herein.

We claim:

1. A telemark ski binding having a front end and a rear end when oriented in the direction of ski travel, the binding comprising:

(a) a base plate for attachment of the binding to a ski;

(b) a telemark binding toe piece pivotally attached to the base plate to permit the toe piece to pivot upward from the ski and toward the front end of the binding;

(c) a lock near the rear end of the binding which when engaged provides a releasable connection between the toe piece and the base plate to prevent said pivoting;

(d) an actuator to engage and disengage the lock, the actuator being at the front end of the binding to be positioned over the ski; and (e) a link between the actuator and the lock, wherein the lock comprises a sliding receiver on the base plate that cooperates with a latch connected to the toe piece.

2. The binding of claim 1, wherein the link is a solid link.

3. The binding of claim 1, wherein the actuator comprises a lever which operates a rotating element, and wherein there is an eccentric connection between the rotating element and the solid link.

4. The binding of claim 1 wherein the latch comprises at least two spaced-apart posts which support the toe piece on the base plate.

5. The binding of claim 4, wherein the posts are connected by a bar which is received by the sliding receiver.

6. The binding of claim 5, wherein the bar has a narrowed profile on its bottom surface.

7. The binding of claim 1, further comprising a resilient dampener on the base plate, the dampener being compressed when the toe piece is pivoted toward the base plate.

8. The binding of claim 1, further comprising a pivot body, the pivot body being pivotally connected to the base plate and the toe piece being removably attached to the pivot body.

9. A telemark ski binding having a front end and a rear end when oriented in the direction of ski travel, the binding comprising:

(a) a base plate for attachment of the binding to a ski;

(b) a pivot body pivotally attached to the base plate;

(c) a telemark binding toe piece removably attached to the pivot body, the pivot body permitting the toe piece to pivot upward from the ski and toward the front end of the binding;

(d) a lock near the rear end of the binding which when engaged provides a releasable connection between the toe piece and the base plate to prevent said pivoting;

(e) an actuator to engage and disengage the lock, the actuator being at the front end of the binding to be positioned over the ski; and (f) a link between the actuator and the lock.

* * * * *